United States Patent [19]

Taplin et al.

[11] 4,169,440

[45] Oct. 2, 1979

[54] CRUISE ECONOMY SYSTEM

[75] Inventors: Lael B. Taplin, Bloomfield Hills; James D. Bode, Royal Oak, both of Mich.

[73] Assignee: The Bendix Corporation, Southfield, Mich.

[21] Appl. No.: 856,452

[22] Filed: Dec. 1, 1977

[51] Int. Cl.[2] ..... F02D 5/00

[52] U.S. Cl. ..... 123/119 EC; 60/276; 60/285; 123/119 R; 123/32 EA

[58] Field of Search ..... 123/119 EC, 119 R, 32 EA, 123/32 EE, 32 EH, 32 EL; 60/276, 285

[56] References Cited

U.S. PATENT DOCUMENTS

| | | | |
|---|---|---|---|
| 3,734,068 | 5/1973 | Reddy | 123/32 EA |
| 3,745,768 | 7/1973 | Zeibnall et al. | 60/285 |
| 3,789,816 | 2/1974 | Japlin et al. | 123/32 EA |
| 3,981,288 | 9/1976 | Wessel | 123/32 EE |
| 4,033,122 | 7/1977 | Musaki et al. | 60/285 |
| 4,077,364 | 3/1978 | Aoki | 60/285 |

FOREIGN PATENT DOCUMENTS

| | | | |
|---|---|---|---|
| 965507 | 4/1975 | Canada | 123/32 EH |

OTHER PUBLICATIONS

Closed-Loop Electronic Fuel Injection Control of the Internal Combustion Engine, SAE #730005, Jan. 1973.

*Primary Examiner*—Charles J. Myhre
*Assistant Examiner*—R. A. Nelli
*Attorney, Agent, or Firm*—William A. Marvin; Russel C. Wells

[57] ABSTRACT

A closed loop integral control system for the air/fuel management of an internal combustion engine is disclosed. An oxygen sensor positioned in the exhaust gas of the internal combustion engine is biased with a constant current source to provide a signal indicative of the oxygen content of the exhaust gas over a significant range of air/fuel ratios. The signal waveform from the sensor is compared to a threshold value of a comparator to produce level changes in the comparator output depending on whether the output of the sensor is above or below the threshold. An integrator, receiving these level changes as commands to increase or decrease the fuel pulse widths, controls the air/fuel ratio of the engine in a limit cycle around a scheduled value. By changing the current bias on the sensor and thus modifying the unbiased waveform of the sensor to intercept the threshold value at various points different average air/fuel ratios are obtainable from the system. According to another feature of the invention, cruise detection circuitry determines when the engine is in a stable non-accelerating/decelerating mode and enables the current source to bias the sensor to produce a relatively lean air/fuel ratio from the system for an economical optimum cruising operation.

28 Claims, 11 Drawing Figures

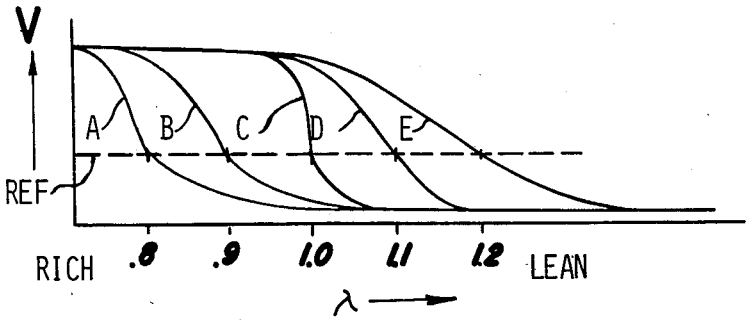
Fig-3
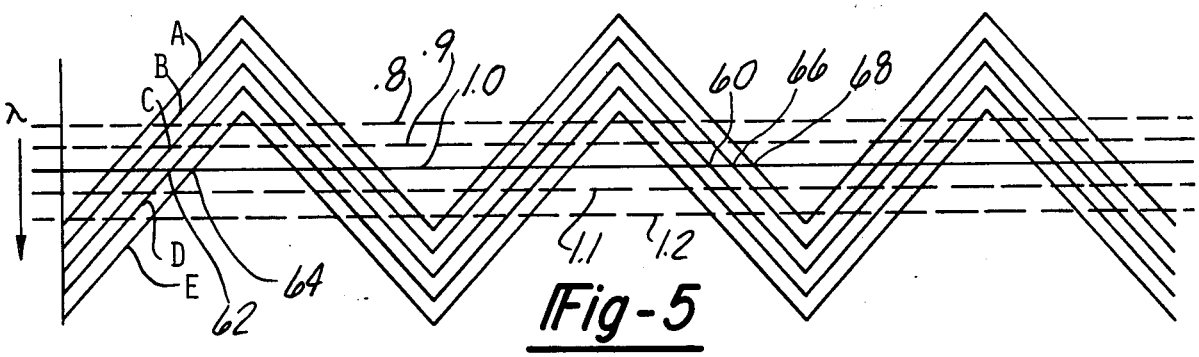
Fig-5
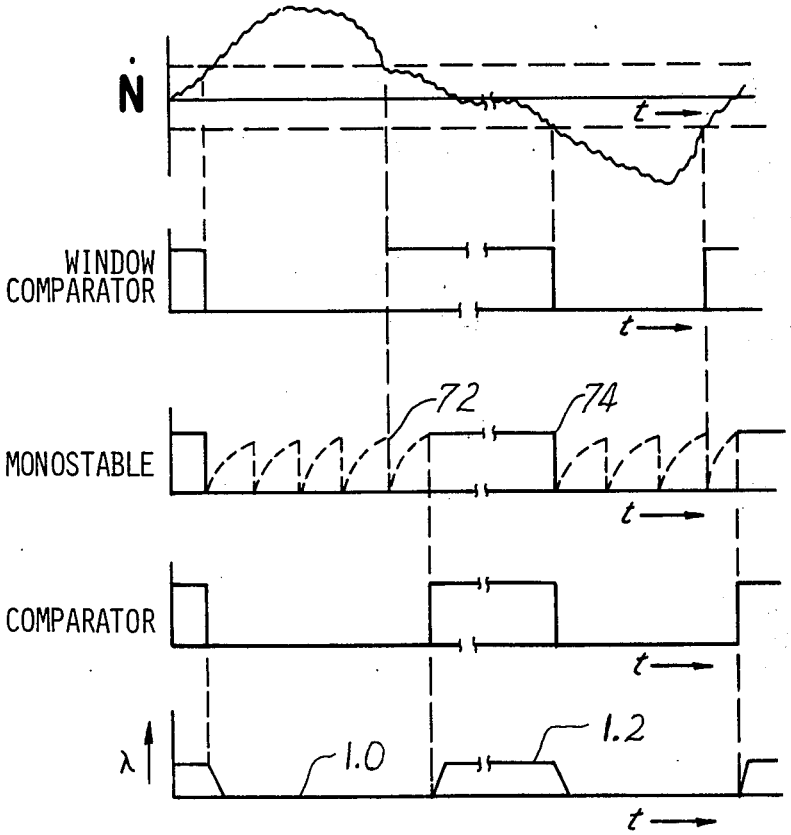
Fig-6a
Fig-6b
Fig-6c
Fig-6d
Fig-6e

CRUISE ECONOMY SYSTEM

CROSS REFERENCE TO RELATED APPLICATIONS

The present application is related to an application, U.S. Ser. No. 856,451 entitled, "Cruise Economy System", filed in the name of Lael B. Taplin on Dec. 1, 1977.

BACKGROUND OF THE INVENTION

1. Field of the Invention

The invention pertains generally to closed loop fuel management systems having an oxygen sensor positioned in the exhaust gas of an internal combustion engine for sensing the constituent makeup of the exhaust gas and is more particularly directed to optimization techniques for fuel economy while utilizing such fuel management systems.

2. Prior Art

There are many and diverse examples of air/fuel ratio controllers for internal combustion engines in the art. Generally, controllers of this type adjust or regulate the amount of fuel mixed with the ingested air of an internal combustion engine to provide the most optimal mixture of the two for burning in the cylinders. Numerous operating parameters of the engine may be sensed and applied to various schedules to calculate the ratio desired but generally speed, manifold absolute pressure, and the temperature of the engine and ingested air are the most useful.

The air/fuel mixture normally desired or scheduled for is stoichiometric or $\lambda=1.0$ because of the attendant advantages of relatively good fuel economy and emission control. Close control of the air/fuel ratio around the stoichiometric point is required of such controllers when using three-way catalytic converters as they will operate efficiently only in a very narrow window of air/fuel ratios. It is also known that extended lean operation of an engine will damage some converters and cause a decrease in conversion efficiency. The air/fuel ratio controller with its open loop schedule is therefore a facile method of maintaining an air/fuel ratio close to stoichiometric for an electronic fuel injector system, electronic carburetor apparatus, or other air/fuel regulating devices.

It is evident, however, that an open loop schedule will not be correct at all times for all engines manufactured because of tolerances, wear, maintenance, changing ambient conditions and other variable criteria. To make these open loop schedulers provide even a more precise control of air/fuel ratio self adaptive or closed loop control has been applied to the open loop schedulers. An advantageous closed loop system that controls the air/fuel ratio at stoichiometric enjoying considerable success is one which includes an oxygen sensor position in the exhaust gas of the engine controlled.

The oxygen sensor provides two voltage levels where one is relatively high indicative of a relative absence of oxygen in the exhaust gas or a rich air/fuel ratio and the other is relatively low indicative of a substantial presence of oxygen in the exhaust gas or a lean air/fuel ratio. The switching between the two levels occurs with a relatively rapid slope at the stoichiometric point as the air/fuel ratio passes therethrough.

By providing an integral control law based upon this switching point, a limit cycle oscillation is produced wherein the air/fuel ratio goes below and above stoichiometric in a narrow band whose average is stoichiometric. An example of a closed loop fuel management control system of this type utilizing an $O_2$ sensor is disclosed in a U.S. Pat. No. 3,815,561 issued to Seitz on June 11, 1974 which is commonly assigned with the present application. The disclosure of Seitz is herein expressly incorporated by reference.

Since the slope of the sensor signal when switching at stoichiometric is not infinite, some variation away from stoichiometric, either rich or lean, can be obtained in the average air/fuel ratio by comparing the sensor voltage with a threshold indicative of the air/fuel ratio desired. The variation is, however, unduly limited by the slope of the sensor waveform at the switching point and the better the sensor (steeper slope) the less the variation obtainable. Moreover, the air/fuel ratios desired and set by the threshold will be unreliable as the sensor ages and the characteristic curve of the sensor changes. A constant adjusting of the system will be required to maintain a predetermined or desired air/fuel ratio. A threshold system for operating a closed loop $O_2$ integral controller is disclosed in a U.S. Pat. No. 3,874,171 issued to Schmidt et al on Apr. 1, 1975.

Another system advantageously describes the use of asymmetrical integration for operating a closed loop $O_2$ system at rich or lean air/fuel ratios with a stoichiometric sensor. This system is more fully disclosed in a U.S. Pat. No. 4,099,491 entitled "System For Controlling Any Air/Fuel Ratio With Stoichiometric Sensor and Asymmetrical Integration" in the name of J. N. Reddy and commonly assigned with the present application. The disclosure of Reddy is herein expressly incorporated by reference.

These systems then could provide a means for controlling air/fuel ratio for specific conditions. For example, during many operational times an internal combustion engine may be operated more economically at a leaner air/fuel ratio than stoichiometric. At constant cruise conditions when there are no abnormal loads or acceleration demands, the engine will run smoothly at air/fuel ratios of approximately 18:1 or higher. It would require less fuel for the operation of the engine if in addition to operating at an average air/fuel ratio that is stoichiometric, a closed loop system could switch to different average air/fuel ratios in response to the sensing of certain conditions but still maintain the desirable precise control afforded by an $O_2$ sensor.

SUMMARY OF THE INVENTION

A method and apparatus for operating a closed loop fuel management system having a normally stoichiometric sensor at an average air/fuel ratio that is either stoichiometric or different from stoichiometric.

Preferably, the closed loop fuel management system comprises an oxygen sensor that generates a signal of one level when it senses the presence of oxygen in an exhaust gas and a second level when the absence of oxygen is detected in the gas. A comparator with a threshold voltage between the two levels is utilized for detecting the switching of the unbiased sensor at a constituent exhaust gas representative of a stoichiometric air/fuel ratio. An integrator means receives the comparator output and provides an integral control signal to an air/fuel ratio controller for changing the air/fuel ratio in response to the detection of the switching of the sensor.

For air/fuel ratios that are nonstoichiometric a current source applies a constant current bias to the oxygen sensor to modify the switching characteristic of its waveform. A lean bias is provided by changing the waveform transition during a rich to lean occurrence to occur at leaner air/fuel ratios. A rich bias is provided by changing the waveform transition during a rich to lean occurrence to occur at richer air/fuel ratios. The amount of current bias will determine the change in air/fuel ratio from stoichiometric and the polarity will determine the direction.

According to another specific embodiment of the invention, the current source is controlled by economy cruise circuitry. The cruise circuitry includes an acceleration detector circuit for sensing variations in speed which are applied to a cruise detector circuit that discriminates between large slow variations indicative of accelerations, decelerations, and large load changes and relatively small, fast variations that are present during substantially constant speed and load conditions. A sampling switch operates in response to the cruise detector enabling the current source to bias the air/fuel ratio lean during a cruise detection and to bias the air/fuel ratio at stoichiometric during noncruise conditions.

Therefore, it is an object of the invention to operate a closed loop fuel management system with a normally stoichiometric sensor at air/fuel ratios that are either rich, lean, or stoichiometric.

It is a further object of the invention to provide circuitry to increase fuel economy during cruise conditions.

These and other objects, features, and aspects of the invention will be more fully understood and better described if a reading of the following detailed description is undertaken in conjunction with the appended drawings wherein:

Figure 1:
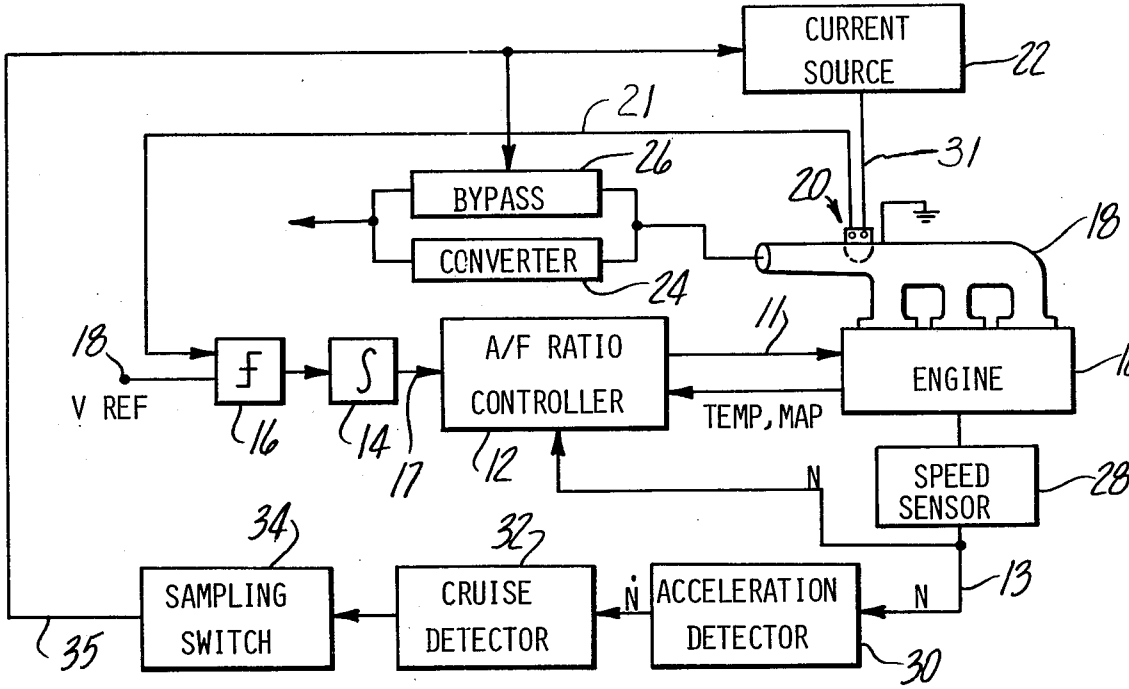
FIG. 1 is a system block diagram of an air/fuel ratio controller system including a cruise economy feature constructed in accordance with the invention.
Figure 2:
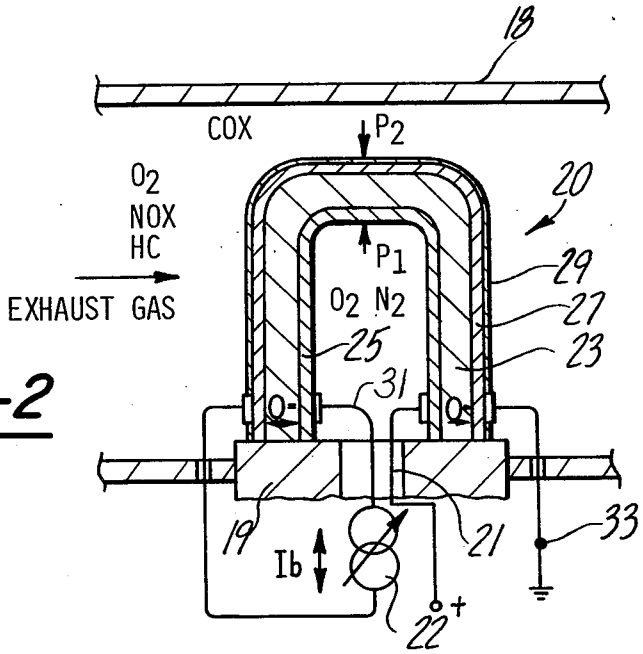
FIG. 2 is a sectioned, inverted side view of the oxygen sensor positioned in the exhaust manifold of the system illustrated in FIG. 1.
Figure 4:
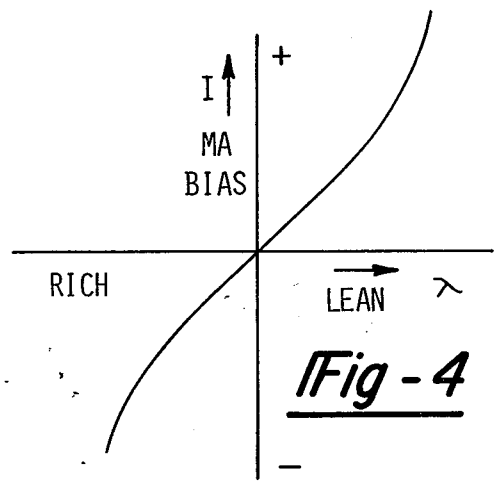
Figure 7:
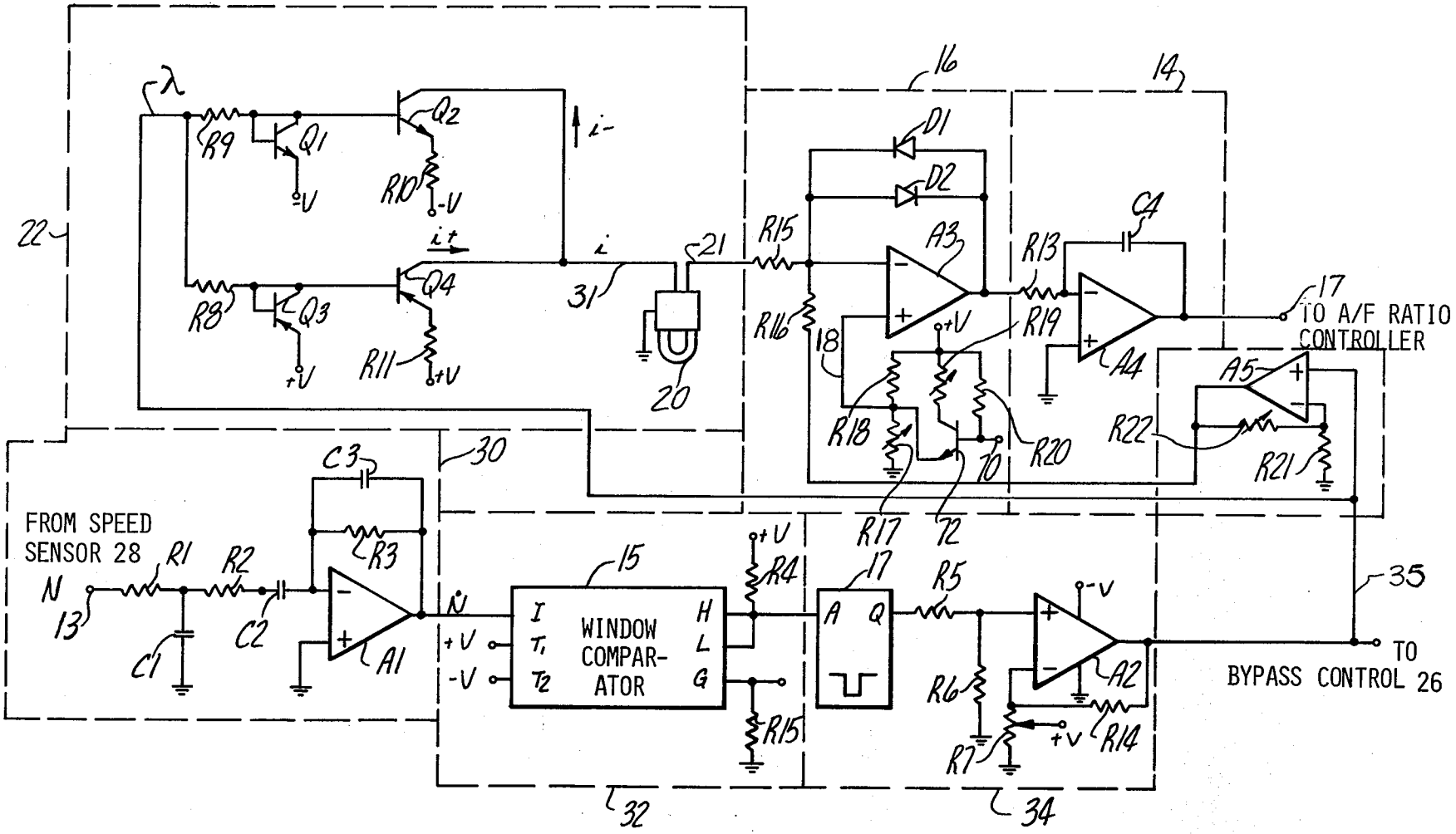

FIGS. *3a–b* are illustrative diagrams showing biased and unbiased waveforms for the sensor illustrated in FIG. 2;

FIG. 4 is a graphic illustration of air/fuel ratio ($\lambda$) as a function of the bias current provided to the sensor illustrated in FIG. 2;

FIG. 5 is an illustrative diagram showing steady state air/fuel ratio waveforms for the system illustrated in FIG. 1 as a result of the sensor waveform transitions illustrated in FIG. 3;

FIGS. 6A–E are illustrative waveforms of various signals found throughout the system illustrated in FIG. 1 when operating in an economy cruise mode; and FIG. 7 is a detailed schematic diagram of circuitry for similarly referenced blocks of the system illustrated in FIG. 1.

DETAILED DESCRIPTION OF THE PREFERRED EMBODIMENTS

With reference now to FIG. 1 there is shown to advantage an air/fuel ratio management system constructed in accordance with the invention and including its attendant advantages. The system comprises, partially, an engine 10 and an air/fuel (A/F) ratio controller 12 which will vary the air/fuel ratio, according to an air/fuel ratio control signal of variable pulse width via control conductor 11, of a controllable mixture device (not illustrated) such as an electronic injection system or an electronically controlled carburetor. Such a controller 12 with a variable pulse width signal could control the mixture device either by regulating the amount of air or the amount of fuel ingested in the engine.

The air/fuel ratio controller 12 is preferably of the open loop type which receives such parameters as air and engine temperature, MAP, and RPM (N) from the engine 10 to calculate a desired air/fuel ratio therefrom. The RPM parameter is transmitted to the controller 12 via speed sensor 28 and sensor line 13 while the temperature and MAP parameters are transmitted to the controller via sensors (not shown) and a sensor line labled TEMP, MAP in the figure. The speed sensor 28 can advantageously comprise a tachometer receiving an input from a toothed gear attached to some rotating member of the engine 10. The temperature and MAP sensors are preferably commonly available analog transducers.

As is conventional, the controller 12 has a programmed schedule which for every value of the measured engine variables will produce an air/fuel ratio dependently thereon. The air/fuel ratio controller 12 could be either digital or analog in its computational mode to provide the air/fuel ratio control signal, but in the preferred form is an analog computational device generating a basic pulse width for an electronic fuel injection system based on the variables of RPM and MAP and corrections thereto. An analog computer of this type is more fully described in a U.S. Pat. No. 3,734,068 issued to Reddy on May 22, 1973 entitled "Fuel Injection Control System" which is commonly assigned with the present application. The disclosure of Reddy is herein expressly incorporated by reference.

Another input to the air/fuel ratio controller 12 is a closed loop integral control signal via line 17 by an integrator 14. The integrator 14 develops the control signal at an output that increases with time at a constant rate or that decreases at a constant rate to vary the pulse width value of the air/fuel ratio controller 12 in a closed loop manner. The integrator 14 switches from its increasing ramp to its decreasing ramp and back again in response to the output of a comparator 16 which is either one of two levels. The comparator 16 changes or switches levels at a point where the waveform voltage of an $O_2$ sensor 20 exceeds a reference voltage input to the comparator 16 at terminal 18. The reference voltage input to the comparator is preferably known to be a voltage that will provide a uniform result even in conditions where the sensor waveform ages as taught in the incorporated Seitz reference.

Normally, an unbiased $O_2$ sensor 20 has an output signal voltage that is relatively high during air/fuel ratios that are rich, where little or no $O_2$ is contained in the exhaust gas, and a low signal when there is an increase or over abundance of $O_2$ in the exhaust products. The sensor waveform switches between the high and low levels at a narrow transition at approximately stoichiometric while the air/fuel ratio controller 12 is increasing or decreasing the air/fuel ratio of the engine through this point. The switching point or stoichiometric point is delayed by the transport lag of the system because a change in A/F ratio at the mixture device will only be noted by the sensor after the combustion products of that change travel to it. This delay and the integration rate of the integrator 14 will set the amplitude and frequency of the characteristic limit cycle oscillation.

In accordance with one important aspect of the invention the waveform of the $O_2$ sensor can be modified to produce a non stoichiometric air/fuel ratio at the engine 10 by biasing the $O_2$ sensor 20 with an adjustable constant current source 22. The current source 22 by supplying various amounts of current through the sensor 20 can be used to modify the waveform to where the comparator 16 will produce its level change at either rich or lean air/fuel ratios, depending on the amount of biasing current and direction, and will produce a stoichiometric switching point when the biasing current source 22 is not on.

According to another important aspect of the invention, in a preferred embodiment current source 22 may be controllably switched on and off by a sampling switch 34 which is connected operably to the output of a cruise detector 32 and an acceleration detector 30. The acceleration detector, which indicates all variations in changes of velocity of the engine, has an input speed signal from the speed sensor 28 via line 13 that is indicative of the instantaneous engine velocity. It is known that small, fast variations and increases in engine velocity may be due to air/fuel ratio changes from the injector means with small, rapid decreases also giving such information. It is further known that larger, slow increases or decreases in speed will be due mainly to operator induced transisents such as accelerations, decelerations, or load changes.

Thus, acceleration detector 30 will differentiate the RPM output, N, of the speed sensor 28 to produce an acceleration waveform from which the cruise detector 32 can determine that the engine 10 is operating at a substantially constant load and speed. This type of operation is termed a cruise operation and will occur for a substantial portion of the operating time of the engine. While at a cruise phase in the operation of the engine, the air/fuel ratio for most efficient operation should be leaned to less than stoichiometric for optimum economy. This leaning effect is possible because the engine during cruise is only using a fraction of the power output from the engine. During these conditions, driveability will not be significantly altered if air/fuel ratios of 18:1 or slightly higher are used even for extended periods of time.

During the time when sampling switch 34 receives an output signal from the cruise detector 32 indicating this condition, the current source 22 is energized and will modify the $O_2$ sensor waveform to vary the waveform to a lean condition at the point where it intercepts the reference voltage of the comparator 16. Conversely, associated with sampling switch 34 is a time constant which, when the opposite condition of an acceleration or deceleration is sensed by cruise detector 32, constantly attempts to time out the circuit and resume the cruise operation. During accelerations and decelerations the current source 22 will be disabled and the $O_2$ sensor loop will function as normal at an air/fuel ratio substantially close to stoichiometric.

Cruise operation as described above would damage some catalytic converters, receiving exhaust gas from the engine exhaust manifold 18. To prevent any damage to the converter 24 during this mode of operation a bypass control 26 is provided which will shunt the exhaust gas around the converter. Conveniently, the bypass control could be a double acting solenoid valve (not shown) which normally closes the bypass. The output of sampling switch 34 via line 35 could be used, as illustrated schematically to open the bypass during the cruise operation.

FIG. 2 shows in cross section the $O_2$ sensor, generally designated 20, positioned in the exhaust system 18 of the engine 10. The exhaust combustion products in the manifold including unburned hydrocarbons, oxides of nitrogen, and carbon along with $O_2$ are passed in proximity to the oxygen sensor 20. The oxygen sensor 20 has a reference port located within an insulator base 19 that receives ambient atmospheric gases comprised essentially of 79 percent nitrogen and 21 percent oxygen in the form of $O_2$. The oxygen sensor 20 further comprises a solid electrolyte oxygen ion conductor 23 of $ZrO_2$ or the like which has an inner electrode 25 of some noble metal, preferably platinum. On the outer surface of the solid electrolyte 23 is a catalytic electrode 27 comprising preferably a noble metal such as platinum. A protective covering of oxide 29, in the preferred embodiment a porous coating of $MgO.Al_2O_3$ spinel, overlays the entire outside active surface of the sensor 20. All the layers 23, 25, 27, and 29 are porous to molecules or ions of oxygen and the two platinum conduction layers 25, 27 have terminals 31 and 33 connected thereto for the collection of electron current. An oxygen sensor of this type is commercially available from Bendix-Autolite of Fostoria, Ohio, with a model number of X-741. A variable (direction and amount) constant current source 22 is provided for biasing the sensor 20 by connecting it to electrodes 25, 27.

Theoretically, the operation of the $O_2$ sensor occurs by $O_2$ molecules becoming oxygen ions with the addition of four electrons at the surface of electrode 25, the oxygen ions then diffusing into the solid electrolyte 23. Since the partial pressure of oxygen is higher on surface 25 than on surface 27, net oxygen ions will move freely through the solid electrolyte to the outer catalytic electrode 27. At this point, the oxygen ions will give up electrons and combine to form $O_2$ molecules once more. A net electron current will thus flow from electrode 25 to electrode 27 and of the polarity indicated in response to the difference of the partial pressure of $O_2$ found in the exhaust gas in relationship to the $O_2$ partial pressure found in the ambient atmosphere. Increasing the difference in partial pressures between the electrodes will, as a rule, increase the voltage created. Generally, a net partial pressure of $O_2$ in the exhaust gas of about $10^{-22}$ atmospheres will cause the sensor to output a voltage of approximately 1.0 V. When the net pressure of oxygen increases, the sensor output voltage decreases becoming less than 0.1–0.2 V when the new partial pressure of $O_2$ in the exhaust gas is $10^{-2}$ atmospheres or more.

Since the voltage generated by the $O_2$ sensor 20 is a function of the difference in partial pressures at electrode 25 and electrode 27, the waveform of the sensor can be modified by artifically creating either a higher or lower $O_2$ partial pressure at the electrode 27 than is generally present because of $O_2$ content of the exhaust gas.

The bias current from source 22 is used to supply electrons to one of the electrodes 25, 27 either to pump $O_2$ molecules from electrode 27 thereby lowering the partial $O_2$ pressure there or to pump $O_2$ molecules to electrode 27 thereby raising the partial $O_2$ pressure there.

If a lean bias is desired electrons are supplied to electrode 27 and oxygen ions generated thereby migrate across the permeable $ZrO_2$ to become $O_2$ molecules at electrode 25 thus lowering the partial $O_2$ pressure at electrode 27. As the sensor 20 begins to switch from a rich to a lean condition, the $O_2$ partial pressure at electrode 27 begins to rise but it will not rise as quickly as the exhaust gas does because oxygen molecules are being transported away from the electrode. The sensor waveform will, therefore, not switch at stoichiometric but will be delayed until the increasing pressure overtakes the loss of pressure generated by the bias current. When switching from lean to rich the $O_2$ pressure will begin to decrease at electrode 27 but it will not have to decrease to a stoichiometric pressure to allow the sensor to switch because the bias current is already transporting $O_2$ away from the surface thus initiating the transition sooner.

Conversely, if a rich bias is desired, electrons are supplied to electrode 25. This causes $O_2$ molecules thereon to ionize and be transported to electrode 27 where they will raise the partial $O_2$ pressure. Subsequently, during sensor transitions when the exhaust gas switches from rich to lean and the partial $O_2$ pressure at electrode 27 is increasing, the additional bias pressures will cause an earlier switching of the sensor waveform. Cycling from lean to rich where the partial $O_2$ pressure will be decreasing at electrode 27 shows a delay in the switching until after the rate of decreasing $O_2$ pressure has overcome the $O_2$ bias pressure developed there.

The bias current causes a greater percentage change in the partial pressure of $O_2$ and the exhaust side of the sensor because the concentration of $O_2$ is generally much lower there. The $O_2$ pressure on the atmospheric side of the sensor will remain substantially unchanged even during bias. Alternatively, a reference $O_2$ pressure may be substituted for atmospheric.

The above description is believed to be at least one theoretical mechanism by which the action of the biased sensor may be explained. However, the application should not be limited to any one mechanism as there may be more than one phenomenon by which the physical response of the sensor under bias may be understood. A U.S. Pat. No. Re. 28,792, issued to Ruka et al on Apr. 27, 1976 discloses oxygen ion transportation in a solid electrolyte such as $ZrO_2$. The disclosure of Ruka is herein incorporated by reference.

FIG. 3 shows the change of the waveform with a bias current imposed on the sensor 20 for a lean air/fuel ratio. The curve C represents an unbiased sensor wherein the transition from a rich to lean mixture takes place sharply with a maximum slope with the reference voltage intercepting the curve at approximately an air/fuel ratio which is stiochiometric or $\lambda=1.0$. Curve D is generated by adding some bias current to the sensor and illustrates that the transition in the waveform is later or at a leaner air/fuel ratio $\lambda=1.1$ than curve C. The next curve E illustrates for the same reference threshold and a greater bias current, even a leaner air/fuel ratio, $\lambda=1.2$, will result when the comparator 16 switches at this value. It is also noted that the curve E has less of a slope than curve C or curve D.

Therefore, it can be stated as a general rule that for increasing bias currents to the sensor 20 that the transitions will occur at greater displacements from the unbiased waveform and with smaller or lesser slopes. The decrease in slopes is believed to be caused by the rate of change of partial pressures at the sensor being decreased by the pressure provided by the bias currents. The lean to rich transition for a sensor biased for lean operation will be a mirror image of the waveforms illustrated in FIG. 3 with the waveforms leading rather than lagging an unbiased waveform. In other words, the sensor will travel the same biased waveform back up as it did down.

Generally for an unbiased waveform it is desired that the transition from 90 percent of the maximum value to 10 percent of the value occurs within approximately 50 millisec. The actual waveform for any sensor will depend upon the sensor configuration and its environment including the rate at which the integrator is changing the air/fuel ratio. The curves, however, in FIG. 3 are independent of time and can be associated with a time parameter only if the rate of change of the air/fuel ratio is known and the system is under closed loop control.

For an understanding of the rich air/fuel ratio bias, attention should again be directed to FIG. 3 where curve C illustrates the transition from a lean to a rich air/fuel mixture for an unbiased sensor. Curve B and curve A illustrate two waveforms where the sensor may be biased with differing currents as previously described. The polarity of the bias current for waveform B and A has been reversed but the magnitude is equivalent to the bias provided for waveformed D, E respectively. It is therefore noted that waveform A is of a lesser slope and occurs at a richer $\lambda$ than waveform C and waveform B. For increasing bias currents then richer air/fuel ratios are possible.

FIG. 4 illustrates the bias current for the sensor as a function in the change in air/fuel ratio caused by the bias current. Positive bias is defined as induced $O_2$ migration opposite to that caused by the partial pressures of the sensor while negative bias is defined as induced $O_2$ migration similar to that caused by the partial pressures. Positive bias currents will increase the air/fuel ratio and negative bias currents will decrease the air/fuel ratio as shown in FIG. 4. The relationship is symmetrical as one would expect for positive and negative bias currents as the amount of oxygen transported by the bias current is proportional to the amount of electrons that are provided to the electrodes of the sensor. The curve is further logarithmic as to the change in $\lambda$ because the sensor follows the Nernst equation which states that the voltage output is a logarithmic function of the ratio of the partial pressures of $O_2$ which the bias modifies. Generally, air/fuel ratios as high as 30:1, or $\lambda=2$, or as low as 10:1, $\lambda=0.7$, are reasonably reachable with this technique.

According to one of the important objects of the invention, there has been shown a method of biasing an $O_2$ sensor to provide either a rich or lean air/fuel ratio from an integral controller. Control of the air/fuel ratio has been shown to be dependent upon the amount and polarity of bias current applied to the sensor. It is assumed that the sensor will be at a substantially constant operating temperature for the purposes of this description, approximately exhaust gas temperature. It is further assumed that during warm up that the system will be operated in an open loop mode as is conventional.

With reference now to the waveforms of FIG. 5 which illustrates the output of the integrator 14 in its limit cycle which will control the air/fuel ratio controller as described hereinabove, an unbiased air/fuel ratio waveform is represented by the waveform C which is shown as symmetrical around the air/fuel ratio $\lambda=1$ or stoichiometric. FIG. 5 further shows new steady state conditions of the integrator waveform after the bias current is on for awhile. For the waveform D corresponding to the similar waveform letter of FIG. 3, the air/fuel ratio switches at a later point 62 and therefore spends an additional amount of time in the lean region of the air/fuel ratio. This additional time biases the overall or average air/fuel ratio to the non-stoichiometric value of approximately 1.1. Similarly for the waveform labeled E, an additional delay at 64 in the switching time is provided. As a consequence, an even leaner air/fuel ratio is developed as an average overall.

For switching to rich air/fuel ratios, waveforms A and B corresponding to waveforms of like letters in FIG. 3, have been drawn in FIG. 5. As before, point 60 is the generalized switching point for a waveform C which will provide a stoichiometric air/fuel ratio as an overall average. Point 66 illustrates where the waveform B will switch because of the delay caused by the biasing current and similarly waveform A illustrates an even later delay 68 where the waveform has been biased with a greater current.

It is seen, therefore, that by biasing the sensor with a constant current, either positive or negative in polarity, different values of air/fuel ratios that are not stoichiometric may be obtained in a facile and reproducible manner. Thus, this system provides a method of varying the air/fuel ratio over a continual range of rich, lean, and stoichiometric values by controlling integrator 14 with the biased waveforms of FIG. 3.

With reference now directed to FIGS. 6 and 7, an economy cruise system incorporating the method of variable current bias for the $O_2$ sensor will now be explained in more detail. The acceleration detector 30 comprises circuitry including filter stages R1, C1; R2, C2; R3, C3; and amplifier A1. The resistor R1 connected between the speed signal input terminal 13 and one lead of the capacitor C1, whose other lead is connected to ground, forms with the capacitor a low pass filter that attenuates high frequency noise from the speed sensor. Connected at the junction of the low pass filter is the serial connection of a resistor R2 and a capacitor C2 joined at the other terminal to the inverting input of amplifier A1. R2, C2 form a differentiator which differentiates the speed component of the sensor signal to produce an acceleration signal at the output of the amplifier A1.

Amplifier A1, which has filter stage comprising a capacitor C3 and resistor R3 connected in parallel between its output and inverting input, is an active low pass filter with its noninverting input connected to ground. In concert with the low pass filter R1, C1 the active filter stage further reduces any noise or high frequency components outside the desired acceleration band and amplifies the differentiated signal.

As can be seen better from the figure waveform FIG. 6A the acceleration signal, N, is comprised of a high frequency component of a small amplitude which is representative of accelerations and decelerations caused by individual cylinder deviations and/or changing air/fuel ratios which are generally described as the roughness of the engine. This roughness signal is superimposed upon a larger, more slowly varying signal with large amplitude changes in the speed as would be provided by transient accelerations/decelerations and/or load changes.

The acceleration signal, N, is input to the terminal I of a window comparator 15 which acts as a dual mode comparator having an upper threshold voltage +V input to the $T_1$ terminal and a lower threshold voltage −V input to the $T_2$ terminal. By comparing the output voltage from the acceleration detector 30 at the terminal I with the two reference voltages, the comparator will produce one of three outputs. If the input voltage, I, is higher than the threshold voltage +V, a relatively low output will be developed at the output terminal H. If the input voltage, I, is lower than the −V reference, the output terminal L will be at a relatively low voltage and if the input voltage is between the two references, the output terminal G will be at a relatively low voltage while L and H are high. The lower and upper thresholds may be different and can be set to tailor the cruise mode of operation to the particular engine. Such a window comparator as described above may be a conventional device which is commercially available from the Burr-Brown Research Corporation of Tucson, Az., with a model number of 4115.

The H output terminal and L output terminal are tied together at the node formed at one terminal of a resistor R4 which has its other terminal connected to a positive supply of voltage +V. It is seen, therefore, this node provides an OR function where large accelerations or decelerations will produce a relatively low output voltage at the node as seen in FIG. 6B.

At other times when the voltage is between the two thresholds as indicated by a relatively high voltage for the window comparator, shown in FIG. 6B, a cruise condition is detected and cruise signal transmitted therefrom. The output terminal G may be used to provide signals for various other parts of this or other circuits and is connected through a resistor R15 to ground. It is seen that the cruise condition or the output of the comparator 15 providing a relatively high voltage occurs a considerable length of time as seen by the broken lines indicating operation of the engine at this condition.

Block 34 of FIG. 7 illustrates circuitry comprising the sampling switch which includes a monostable multivibrator 17 which receives the output of the window comparator 32 to an input terminal A. The waveform for the monostable multivibrator 17 is shown in FIG. 6C. When the window comparator detects a condition that is outside of the cruise window, the monostable will immediately produce a relatively low voltage by switching into its unstable state. The monostable will then start to time out of its unstable state and back into the stable state or high condition. The monostable will check every time period to see if the window comparator has detected the presence of a cruise condition once more. In its asynchronous mode, however, the monostable will be held low by the low value of the window comparator 32.

At some point after a number of timing cycles, for example at point 72, the window comparator 15 will have detected the presence of another cruise condition and the monostable will reset to its stable state, a relatively high condition, until another acceleration occurrence outside of the window has been detected, for example at 74. The monostable 17 has a time constant for its unstable state that is long enough to ensure that small oscillations of the acceleration signal around the threshold voltages do not cause oscillations in the system. Thus, some hysteresis is built into the system in changing from the acceleration to cruise mode to ensure that a cruise condition does exist before leaning the system while a stoichiometric condition is produced and held for the time constant of the monostable immediately upon reaching the thresholds.

Further included in the sampling switch 34 is a noninverting shaping comparator formed with an amplifier A2 connected between a negative voltage and ground. The amplifier A2 has a threshold resistor R7 supplying a reference voltage from a variable wiper connected to a positive source of voltage +V. Input from the monostable 17 to the noninverting terminal of the amplifier A2 is via a pair of divider resistors R5, R6. The divider resistors take a fraction of the voltage output from the monostable and when compared to the threshold developed by resistor R7 the amplifier A2 provides a negative output if the voltage is greater than the threshold and a relatively low output if less than the threshold. For signals above the threshold, a negative feedback resistor R14 is provided between the output and inverting input to shape the signal into a switching waveform of a predetermined voltage level as shown in FIG. 6D.

This voltage level from the sampling switch turns the current of current source 22 off and on to either give a lean air/fuel ratio when a cruise condition is detected or a stoichiometric air/fuel ratio when the accelerations, decelerations, or load changes are detected. The voltage level provided by the output terminal of amplifier A2 will be used to set the air/fuel ratio for the lean excursion of the system. It will be further understood that the cruise signal can be used to change the air/fuel ratio in any of the beforementioned systems such as Reddy, Schmidt, the present current bias arrangement, or combinations thereof.

Block 22 in FIG. 7 illustrates a bipolar controllable constant current source which biases $O_2$ sensor 20 via current line 31. The constant current source 22 comprises two sets of matched transistor pairs $Q_1$, $Q_2$ and $Q_3$, $Q_4$ respectively. Each set forms a variable constant current supply of opposite polarity. For a positive bias, a transistor $Q_3$ has its base and collector terminals connected together at the node formed at the base of a transistor $Q_4$. A bias resistor R8 is further connected between a control input λ and the node. The transistor $Q_4$ is connected at its collector to the current line 31 and at its emitter resistor R11. By supplying a negative polarity to the control terminal λ varying amounts of current will be drawn through the diode connected transistor $Q_3$ and the resistor R8. The amount of current drawn will be dependent upon the value of voltage applied at λ and will be mirrored by the transistor $Q_4$ to the current supply line 31 from source +V and resistor R11 as a positive bias current +i.

Likewise, for a negative current bias a transistor $Q_2$ has its collector terminal connected to current supply line 31 and its emitter terminal connected to a negative supply −V via emitter resistor R10. Input to the transistor $Q_2$ is via a bias resistor R9 connected between the control terminal λ and its base. A diode connected transistor $Q_1$ having base and collector joined is further connected to the base of transistor $Q_2$ at that point and also is provided with an emitter junction to a negative supply −V. Similarly, as with the positive supply, a positive control voltage at the λ terminal will cause a current to flow through resistor R9 and transistor $Q_1$ which will be mirrored in the transistor $Q_2$ as a negative bias current −i.

Thus, it is seen for any desired air/fuel ratio a current bias may be applied to the sensor via current line 31 by current source 22. The magnitude and polarity of the bias current is dependent upon the polarity and amplitude of the voltage supplied to the control terminal λ. Advantageous use is made of this current source 22 by the cruise signal circuitry turning a positive bias current off and on to lean out the air/fuel ratio for the system as illustrated in FIG. 6E.

The output of the sensor 20 in FIG. 7 is connected to the inverting input of an amplifier A3 comprising a portion of the comparator 16 via an input resistor R15. The input resistor R15 is of sufficient magnitude so the bias current to the sensor 20 will not be affected. The threshold for the comparator 16 is developed at the junction of the series connection of a divider resistor R18 and a variable divider resistor R17. The divider combination is connected between a positive voltage +V and ground. The adjustment of the resistor R17 will provide a variable threshold that is input to the noninverting input of the amplifier A3 to a predetermined level.

Back to back diodes D1 and D2 forming a parallel combination between the output of the amplifier A3 and the inverting input provide voltage limiting for the excursions of the output terminal. Thus for transitions of the sensor 20 the output of amplifier A3 is approximately +0.6 V or −0.6 V.

A bucking voltage is supplied to the inverting input of amplifier A3 via an output resistor R16 and an amplifier A4 that is of an equivalent magnitude but opposite in polarity to an offset voltage of the sensor waveform. The offset is caused by the IR drop across the sensor of the bias current since the sensor does have some operating resistance. This offset will not affect the shape of the curves of FIG. 3 but will merely produce a level shift that can be canceled.

The magnitude of the shift, positive or negative, is dependent upon the amount of current bias since at operating temperatures the sensor will maintain a substantially constant low resistance. Therefore, the offset will be related by some gain constant to the voltage at terminal λ. Amplifier A5 provides this bucking voltage by receiving the voltage from the λ terminal via the noninverting input and multiplying it by the gain constant of the amplifier. The gain constant can be adjusted by varying a variable resistor R20 connected between the output and inverting input of amplifier A5 in relation to a fixed resistor R21 connected between the inverting input and ground.

When the comparator senses that the voltage of the $O_2$ device exceeds the threshold it will produce a relatively low voltage and when the voltage supplied by the $O_2$ device is less than the threshold it will provide a relatively high voltage.

The output from the comparator 16 is transmitted via an input resistor R13 to the inverting input of an integrating amplifier A4 which has its positive or its noninverting terminal connected to ground. An integrating capacitor C4 is connected between the output and the inverting input to produce voltage changes in relationship to the levels provided by the comparator. For a low level input from the comparator, indicating a rich air/fuel ratio sensed by the $O_2$ device, the integrator will produce a relatively increasing ramp whose slope is dependent upon the time constant of C4 and R13. The integrator amplifier A4 will alternately produce a decreasing ramp waveform for time periods when the output of the comparator amplifier A3 is relatively high and at the same slope as the increasing ramp. The method and operation of the comparator 16, the integrator 14, and air/fuel ratio controller 12 are more fully described in the incorporated Seitz reference where they are additionally shown by similar circuitry to advantage.

Additionally, it will be evident from the description of the system that for any set bias current to the sensor 20, the threshold of the comparator 16 may be adjusted to change the average air/fuel ratio of the system over a substantial range because of the decreased sensor slope at its transition between high and low outputs. Greater bias currents, either rich or lean, will provide a means for greater adjustment as the slope of the transition decreases.

For example, a set positive bias current allowing the system to operate along curve E of FIG. 3 could be used in conjunction with a NPN transistor 72 to change the average air/fuel ratio. The transistor is usually biased in an on state by the connection of its base terminal to a positive supply +V via a bias resistor R20. The transistor 72 additionally is connected by its collector terminal to the positive supply +V via a variable divider resistor R19 and to the threshold junction of amplifier A3 by its emitter terminal. A negative voltage applied to base terminal 70 will turn the transistor 72 off.

By connecting the cruise signal via the output of amplifier A2 to terminal 70, a switching between stoichiometric and a lean air/fuel ratio would be accomplished. During non cruise conditions the output of amplifier A2 would allow the transistor 72 to remain on and resistor R19 could be adjusted to operate at the stoichiometric point of the curve E in FIG. 3. When detecting a cruise condition the negative voltage of amplifier A2 would turn off transistor 72 and a lower threshold would result. The lower threshold set by the resistor R17 could operate along the curve E at any lean air/fuel ratio desired.

While a preferred embodiment of the present invention has been shown and described it will be obvious to those skilled in the art that it should not be so limited because this disclosure will be susceptible to various changes and modifications to the aspects thereof without departing from the spirit and scope of the invention as will be claimed hereinafter.

What is claimed is:

1. A method of air/fuel ratio management for an internal combustion engine comprising:

providing an exhaust gas sensor in the exhaust system of said internal combustion engine which is operable to generate a waveform dependent upon the constituent composition of said exhaust gas;

controllably generating a modification signal input to said exhaust sensor, said sensor changing the generated waveform in response to the modification signal and as a function of the modification signal; and regulating said air/fuel ratio of the internal combustion engine with the modified waveform generated by said exhaust gas sensor such that the air/fuel ratio will be controlled by the modification signal.

2. A method of air/fuel ratio management for an internal combustion engine as defined in claim 1 wherein said step of providing an exhaust gas sensor includes said step of:

providing said sensor wherein the sensor is sensitive to the oxygen content of the exhaust gas and said waveform is representative thereof.

3. A method of air/fuel ratio management for an internal combustion engine as defined in claim 2 wherein said step of providing an exhaust gas sensor includes said step of:

providing said oxygen sensor wherein said waveform is generated as a function of the partial pressure of oxygen contained within said exhaust gas.

4. A method of air/fuel ratio management for an internal combustion engine as defined in claim 3 wherein said step of providing an exhaust gas sensor includes said step of:

providing said oxygen sensor wherein said waveform is generated as a function of the ratio of the partial oxygen pressure of the exhaust gas to the partial oxygen pressure of a reference source, said sensor generating relatively low waveform outputs for substantial amounts of oxygen in the exhaust gas and relatively high waveform outputs for a relative absence of oxygen in the exhaust gas.

5. A method of air/fuel ratio management for an internal combustion engine as defined in claim 4 wherein said step of controllably generating a modification signal includes the step of:

changing at least one of said oxygen partial pressures of said exhaust gas and said reference source that is sensed by the sensor in response to the modification signal.

6. A method of air/fuel ratio management for an internal combustion engine as defined in claim 4 wherein said step of regulating the air/fuel ratio includes the steps of:

increasing the air/fuel ratio for the relatively high waveform outputs from the sensor above a threshold; and decreasing the air/fuel ratio for the relatively low waveform outputs from the sensor when below said threshold.

7. A method of air/fuel ratio management for an internal combustion engine as defined in claim 6 wherein said step of controllably generating said modification signal includes the step of:

controllably generating an air/fuel ratio above stoichiometric including generating a signal causing the sensor to delay the transition of said waveform from the relatively high output to the relatively low output.

8. A method of air/fuel ratio management for an internal combustion engine as defined in claim 7 wherein said step of controllably generating an air/fuel ratio above stoichiometric further includes the step of:

generating a signal causing the sensor to anticipate the transition of said waveform from the relatively low output to the relatively high output.

9. A method of air/fuel ratio management for an internal combustion engine as defined in claim 6 wherein said step of controllably generating said modification signal includes the step of:

controllably generating an air/fuel ratio below stoichiometric including generating the modification signal causing the sensor to delay the transition of said waveform from the relatively low output to the relatively high output.

10. A method of air/fuel ratio management for an internal combustion engine as defined in claim 9 wherein said step of controllably generating an air/fuel ratio below stoichiometric further includes the step of:

generating a signal causing the sensor to anticipate the transition of said waveform from the relatively high output to the relatively low output.

11. In an air/fuel ratio management system for an internal combustion engine having a closed loop integrator means and including an air/fuel ratio controller for regulating the air/fuel ratio of the engine in response to the operating parameters of the engine and in response to said integrator means, said system further including an exhaust gas sensor generating a signal of a first level when the presence of oxygen is detected in the exhaust gas and a second level when the absence of oxygen is detected in the exhaust gas, said sensor switching rapidly between said first and second levels at a transition slope which occurs substantially at a stoichiometric air/fuel ratio, said integrator means responding to said transition to regulate the air/fuel ratio of the engine; an improvement comprising:

a current source, electrically connected to said sensor, for biasing the sensor with controllable amounts of current, said sensor modifying said transition in response to said bias current such that the air/fuel ratio of the engine is changed dependently upon said bias current.

12. An air/fuel ratio management system for an internal combustion engine comprising:

an exhaust gas sensor located in the exhaust system of said internal combustion engine which is operable to generate a waveform dependent upon the constituent composition of said exhaust gas;

means for controllably generating a modification signal input to said sensor, said sensor changing the generated waveform in response to the modification signal and as a function of the modification signal; and means for regulating said air/fuel ratio of the internal combustion engine with the modified waveform generated by said exhaust gas sensor such that the air/fuel ratio will be controlled by the modification signal.

13. An air/fuel management system as defined in claim 12 wherein said exhaust gas sensor generates said waveform in response to the partial pressure of oxygen in said exhaust gas.

14. An air/fuel management system as defined in claim 13 wherein said exhaust gas sensor generates said waveform as a function of the ratio of the partial pressure of oxygen in said exhaust gas and a reference source.

15. An air/fuel management system as defined in claim 14 wherein said reference source is atmospheric and said sensor generates a voltage waveform with a relatively high value when there is a relative absence of oxygen in the exhaust gas and a relatively low value when there is a substantial presence of oxygen in the exhaust gas.

16. An air/fuel management system as defined in claim 15 wherein said modification means includes a current source for supplying a controllable bias current to said sensor, said bias current causing a controllable change in said waveform.

17. An air/fuel management system as defined in claim 16 wherein said current bias increases the partial pressure of oxygen sensed in the exhaust gas to modify said waveform.

18. An air/fuel management system as defined in claim 16 wherein said current bias decreases the partial pressure of oxygen sensed in the exhaust gas to modify said waveform.

19. An air/fuel management system as defined in claim 17 or claim 18 wherein said regulating means includes:

an integrator means for increasing the air/fuel ratio when said waveform is relatively high and in excess of a threshold and for decreasing the air/fuel ratio when said waveform is relatively low and below said threshold.

20. An air/fuel ratio management system as defined in claim 11 wherein:

said current source modifies said transition such that it is displaced and delayed from occuring at a stoichiometric air/fuel ratio.

21. An air/fuel ratio management system as defined in claim 20 wherein:

said current source modifies said transition such that it is displaced and occurs prior to a stoichiometric air/fuel ratio.

22. An air/fuel ratio management system as defined in claim 21 wherein:

the amount of said displacement is proportional to the amount of bias current and the direction of said displacement is dependent upon the polarity of the bias current.

23. An air/fuel ratio management system as defined in claim 11 wherein:

said exhaust gas sensor comprises an outer catalytic electrode exposed to said exhaust gas and contacting an outside surface of a solid electrolyte layer of zirconium dioxide, and an inner catalytic electrode exposed to a reference source of oxygen and contacting an inside surface of the solid electrolyte; said first and second levels being developed as voltage between the electrodes wherein said inner electrode is positive with respect to said outer electrode; and said current source applies said bias current to said inner electrode.

24. An air/fuel ratio management system as defined in claim 23 wherein:

said current source includes means for biasing said sensor with positive bias current.

25. An air/fuel ratio management system as defined in claim 24 wherein:

said current source further includes means for biasing said sensor with negative bias current.

26. An air/fuel ratio management system as defined in claim 25 wherein:

said positive bias current means is voltage controlled and includes a PNP transistor with its emitter terminal electrically connected to a positive voltage supply through a resistor, its collector terminal electrically connected to said inner electrode, and its base terminal electrically connected to the collector terminal of a second PNP transistor whose emitter terminal is electrically connected to said positive supply and whose base terminal is electrically connected to its own collector terminal; the base terminal of said second PNP transistor further being resistively coupled to a control terminal where a control voltage is applied to regulate said positive bias current.

27. An air/fuel ratio management system as defined in claim 26 wherein:

said negative bias current means is voltage controlled and includes an NPN transistor with its emitter terminal electrically connected to a negative voltage supply through a resistor, its collector terminal electrically connected to said inner electrode, and its base terminal electrically connected to the collector terminal of a second NPN transistor whose emitter terminal is electrically connected to said negative supply and whose base terminal is electrically connected to its own collector terminal; the base terminal of said second NPN transistor further being resistively coupled to a second control terminal where a control voltage is applied to regulate said negative bias current.

28. An air/fuel ratio management system as defined in claim 27 wherein:

said control terminal and said second control terminal are the same terminal, and;

wherein said positive and negative bias currents are regulated by the same control voltage.

* * * * *